United States Patent [19]

Orme

[11] 3,982,733

[45] Sept. 28, 1976

[54] GIMBALED SHEAVE WITH CABLE ANGLE SENSORS

[75] Inventor: Myrl E. Orme, Canoga Park, Calif.

[73] Assignee: The Bendix Corporation, North Hollywood, Calif.

[22] Filed: Jan. 8, 1975

[21] Appl. No.: 539,556

Related U.S. Application Data

[62] Division of Ser. No. 400,478, Sept. 24, 1973, Pat. No. 3,902,701.

[52] U.S. Cl. ..... 254/173 R; 200/153 N; 254/190 R

[51] Int. Cl.[2] ..... B66D 1/36

[58] Field of Search ..... 254/190 R, 173 R; 285/261; 200/153 N, 295, DIG. 29; 250/234; 248/182, 181

[56] References Cited

UNITED STATES PATENTS

| | | | |
|---|---|---|---|
| 2,373,413 | 4/1945 | Plummer | 254/173 R |
| 2,447,344 | 8/1948 | Kliever | 250/234 |
| 2,703,505 | 3/1955 | Senn | 250/234 |
| 3,215,405 | 11/1965 | Walsh | 254/173 R |
| 3,679,906 | 7/1972 | Myers | 250/234 |

*Primary Examiner*—L. J. Paperner
*Assistant Examiner*—Kenneth Noland
*Attorney, Agent, or Firm*—Robert C. Smith; William F. Thornton

[57] ABSTRACT

A payout sheave for a cable connecting an underwater transducer array or instrumentation package to processing and display equipment directs the cable as it is payed out and in toward a reel and level wind mechanism carried in a platform vehicle such as a boat or helicopter. The supporting frame for the sheave includes a cross member supported along a first axis in bearings in the frame and which carries additional bearings at its center. These center bearings carry an intermediate support structure which is rotatable thereon along a second axis perpendicular to the axis of the cross member. This intermediate support structure carries a pair of journals and bearings oriented along a third axis perpendicular to each of the first and second axes. A fork member is attached to the intermediate support structure through the bearings, and the sheave is carried in the bifurcated section of this member and thus, in effect, is gimbaled for movement along all three axes. A first rotary linear transformer is mounted on the frame such that its rotor moves with the cross member, and a second such transformer is carried on the intermediate support structure with its rotor responsive to movement of the fork member relative to the intermediate support member. These rotary linear transformers each provide electrical output signals varying with the departure of the cable from a null position with respect to the first and third axes, and such signals are used in a navigation or autopilot system for the platform vehicle. A second embodiment provides for movement along the described three axes through the use of a monoball structure carried on a journaled cross member with the fork carried on its monoball and the electrical position signals being supplied by a lamp mounted on the fork which moves its beam over the surface of a two-axis photocell. The output of the photocell varies with the direction and extent of departure of the beam from a null position.

3 Claims, 4 Drawing Figures

A
68
66
70
58
60
TO
LEVEL WIND
64
54
62
52
A
64
50

68
66
60
56
58
64
54
52
10

GIMBALED SHEAVE WITH CABLE ANGLE SENSORS

This is a division of application Ser. No. 400,478 filed Sept. 24, 1973, now U.S. Pat. No. 3,902,701 issued on Sept. 2, 1975.

BACKGROUND OF THE INVENTION

There are a number of applications for a reeling machine used in connection with a device which is suspended or lowered at the end of a cable from a platform such as a ship or a helicopter. In the case of a device suspended from a helicopter, it may become important that the angle of the cable as it leaves the reeling mechanism be sensed and used as an input to the helicopter controls to keep the helicopter hovering over the suspended device. Cable angle sensors have been used in the form of rollers held in contact with the cable. This operates reasonably satisfactorily, but does increase wear on the cable. Also, the payout sheave itself has, in the past, been built to rotate in only one plane, and since it is used in conjunction with a level wind mechanism on or associated with the reel, the angle of contact of the cable with the sheave as it leaves the level wind mechanism may vary such as to cause substantial additional wear on the cable. In recent applications for such reeling machines, the reeling speeds and the length of cable reeled have been increased such that the wear and scuffing problem resulting from non-alignment of the cable with the sheave has become quite severe.

SUMMARY OF THE INVENTION

With a high speed reeling operation, it has been found that the scuffing or wear of both the cable and the flange of the payout sheave has been quite severe, at least partly because of the large angles of approach of the cable to the sheave when the level wind mechanism is reeling cable near the outer edges of the reel. To solve this problem, applicant has devised a suspension mechanism for the payout sheave which permits the sheave to follow the angle of approach or departure of the cable to or from the reel. Since the platform vehicle also may not be perpendicular to the cable as it is suspended therefrom, it is also desirable that the suspension mechanism permit the payout sheave to follow this angle. Thus, a gimbaled suspension mechanism has been designed which permits the payout sheave to seek an angle in any of three planes which minimizes the force components perpendicular to the instantaneous direction of travel of the cable. This has been accomplished by attaching the supporting or fork for the payout sheave to a pivoted support structure wherein a first pair of bearings permit the sheave to rotate around an axis which projects to substantially the center line of the cable as it rides on the top of the sheave to or from the level wind mechanism. A third pivot permits rotation around an axis which projects to substantially the center line of the cable as it leaves the sheave toward the suspended device, and a third pivot permits rotation normal to the first two axes.

Since the support structure for the payout sheave is gimbaled to follow the cable angle, it becomes possible to make use of the fact that the positions of parts of the support structure are directly related to the cable angle to avoid the need for cable-contacting rollers to sense cable angle. Applicant has therefore utilized followers in the form of rotary linear transformers positioned to sense movement around two of the three axes of rotation. This transformer is designed such that it has no voltage out at null and with the phase and magnitude of its output responsive to the direction and magnitude of departure of the support structure from a null position.

A second embodiment of the support structure uses a monoball pivot structure to permit movement in all three dimensions in combination with a lamp and photocell arrangement wherein a lamp is located on the sheave fork and the four-axis photocell is positioned on the support structure. As the cable pulls the sheave and fork off a null position, the lamp is directed to one of the separate photocell quadrants, thus producing a control signal whose polarity and magnitude is indicative of the direction and departure of the sheave from its null position.

DESCRIPTION OF THE PREFERRED EMBODIMENTS

Figure 1:
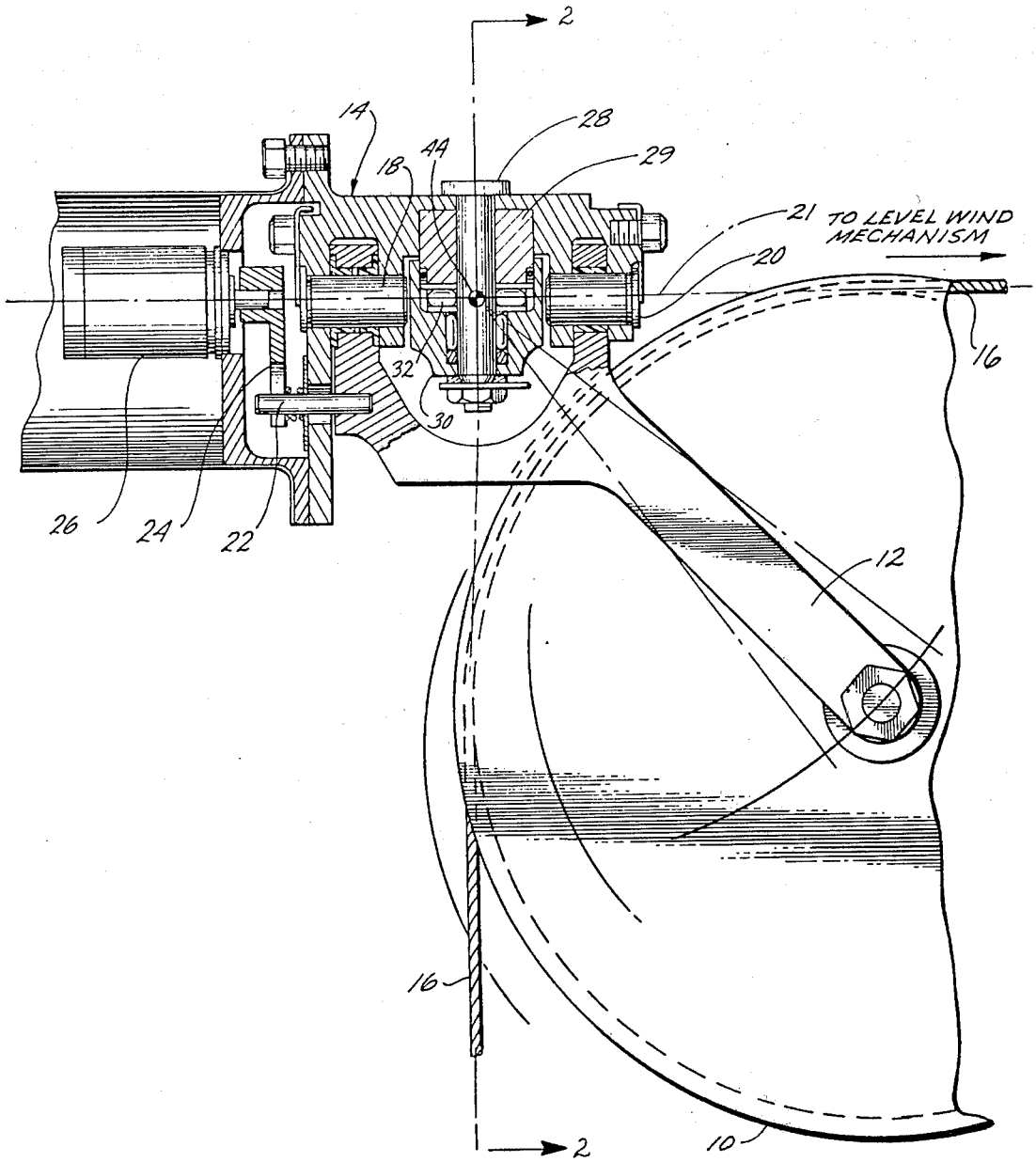
FIG. 1 is a side view, partly in section, of a gimbaled sheave support made according to my invention.

Referring now to FIG. 1, a payout sheave 10 is supported in a fork member 12 fastened to a support structure shown generally at numeral 14. An underwater transducer or instrumentation package is suspended into the water at the lower end of a cable 16 which is directed around sheave 10 toward a level wind mechanism, not shown. The level wind mechanism, which could be any of several available devices known in the art, winds the cable 16 on a cable reel, also not shown, and which is or may be conventional.

Fork 12 is supported on a pair of bearings 18, 20 such that it is free to rotate around an axis 21 in direct alignment with the groove at the top of sheave 10, as shown. Movement around this axis is transmitted from fork 12 through a pin 22 to an arm 24 fastened to the center shaft of a rotary linear transformer 26. The fork 12 and its support 14 are pivotable around a vertical axis through the center line of a pin 28 which passes through a bearing block 29 and a roughly cup-shaped bearing support member 30, providing the lower support for a set of bearings 32. This arrangement permits movement of sheave 10, fork 12 and support 14 around the pin 28 as bearing block 29 rotates on bearings 32. A second set of bearings 33 provides for relative movement between pin 28 and support member 30.

Figure 2:
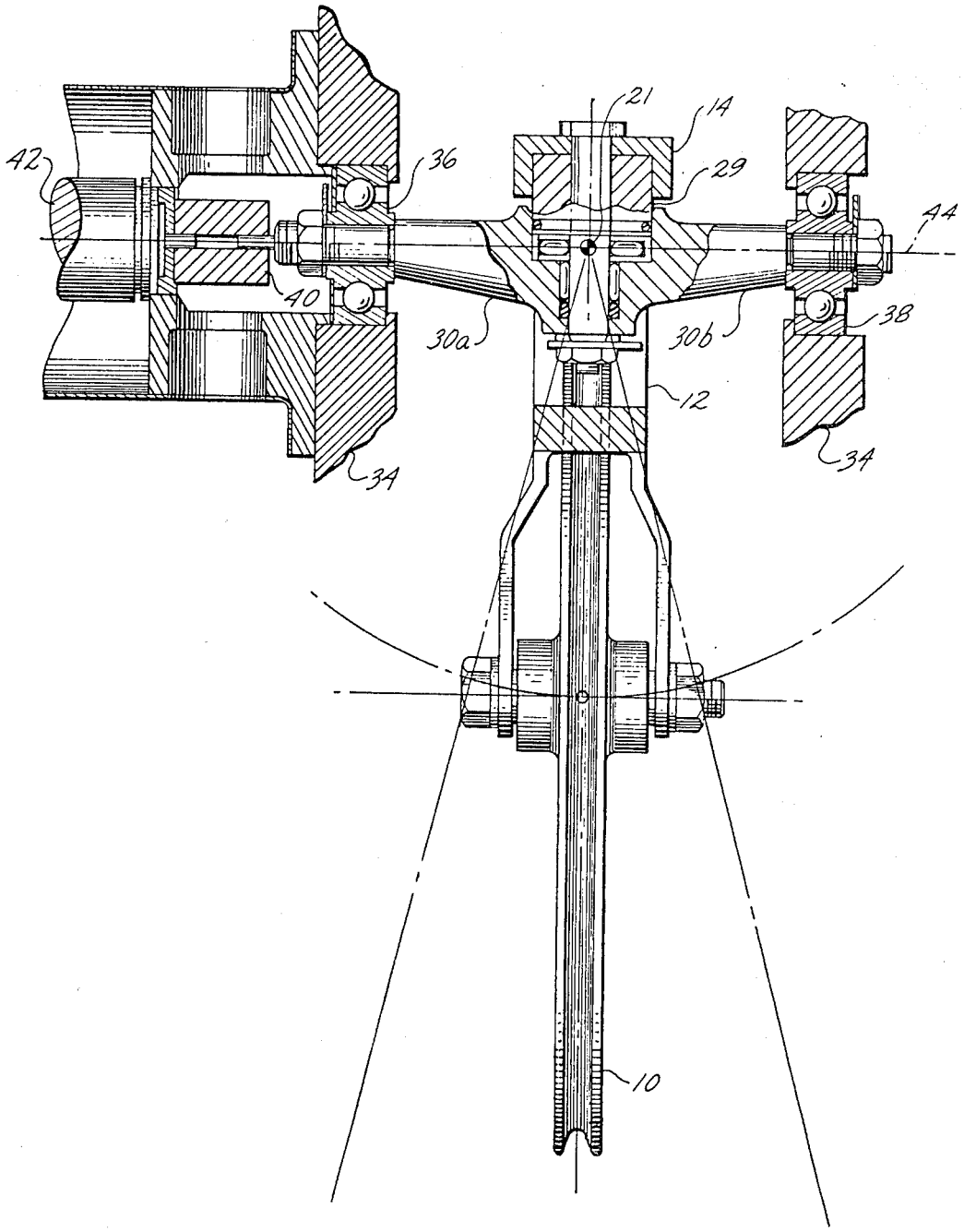
FIG. 2 is a sectional view of the device of FIG. 1 taken along line 2—2 of FIG. 1.

FIG. 2 is a section taken along line 2—2 of FIG. 1 and shows the structure permitting the sheave 10 to rotate in a fork 12 around a horizontal axis 44. The support of fork 12 by member 14 through bearings 18 and 20 is shown only on FIG. 1. Bearing block 29 is shown riding on bearings 32, and the bearing support member 30 is seen in this view as having laterally extending arms **30*a* and 30*b*, which are carried in a frame 34 by means of bearings 36 and 38. Splined to an extension of arm 30*a* by means of a collar 40 is a second rotary linear transformer 42 which responds to rotation of the sheave 10 around the axis 44 by generating an electrical signal varying with the direction and extent of departure of the sheave 10** from a null position.

In considering the operation of the device of FIG. 1, it will be recognized that the organization shown therein is supported in a frame structure only suggested at numerals 34. Normally attached to this frame structure is a level wind mechanism which, in turn, controls the winding and unwinding of the cable 16 from a conventional reel. Depending upon the width of the reel and the geometry of the frame structure, the level wind mechanism, which also functions during unwinding, may typically cause the angle of cable 16 as it approaches the sheave to depart significantly from axis 21. In applicant's particular installation, this angle was found not to exceed about 7° on each side of the line represented by axis 21, but even this angle is sufficient to cause appreciable scuffing. Movement about this vertical axis, which is largely the result of the level wind mechanism, in not of significance insofar as the control of the platform vehicle is concerned. Movement around axis 21 as shown in FIG. 2, however, would indicate that the platform vehicle is no longer directly over the load device at the end of cable 16, and the cable is not descending vertically, but at an angle. This departure angle is sensed by the rotary linear transformer 26, and a signal varying with the direction and extent of departure from vertical is provided to the navigation system to produce a correction. Essentially the same may be said with respect to movement around axis 44 resulting in output signals from transformer 42. The cable 16 will normally not depart from vertical by more than about 15°, and movement of the various members described above is normally within this range.

Figure 3:
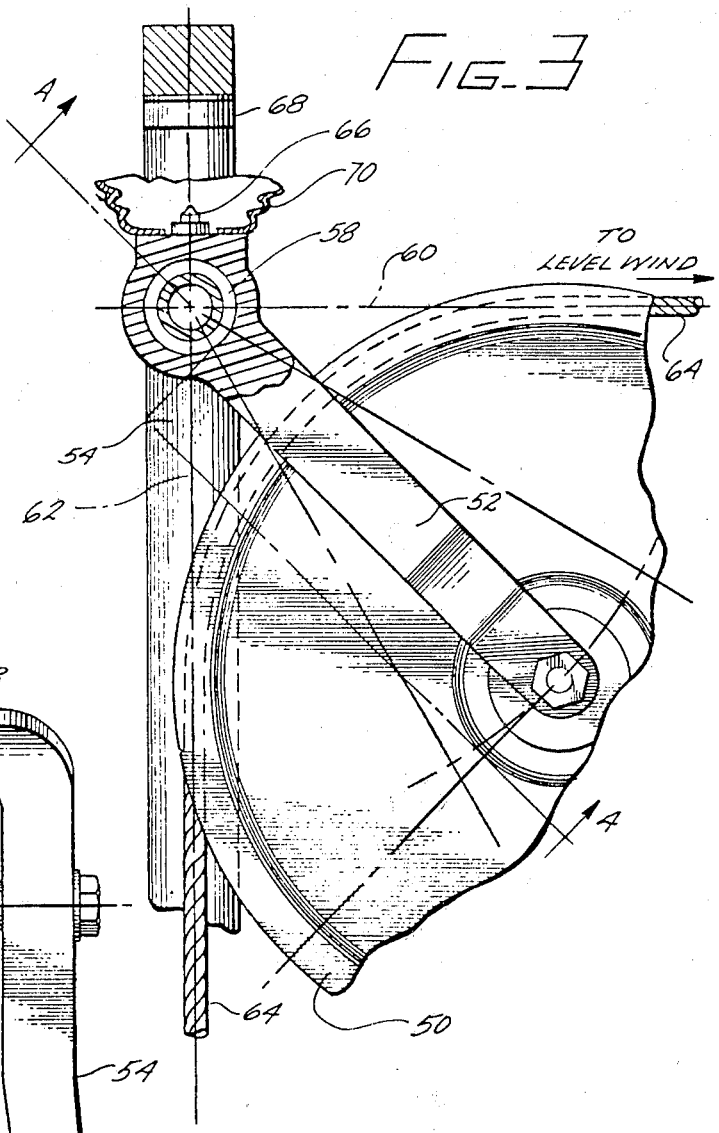
FIG. 3 is a side view, partly in section, of another embodiment of my invention.
Figure 4:
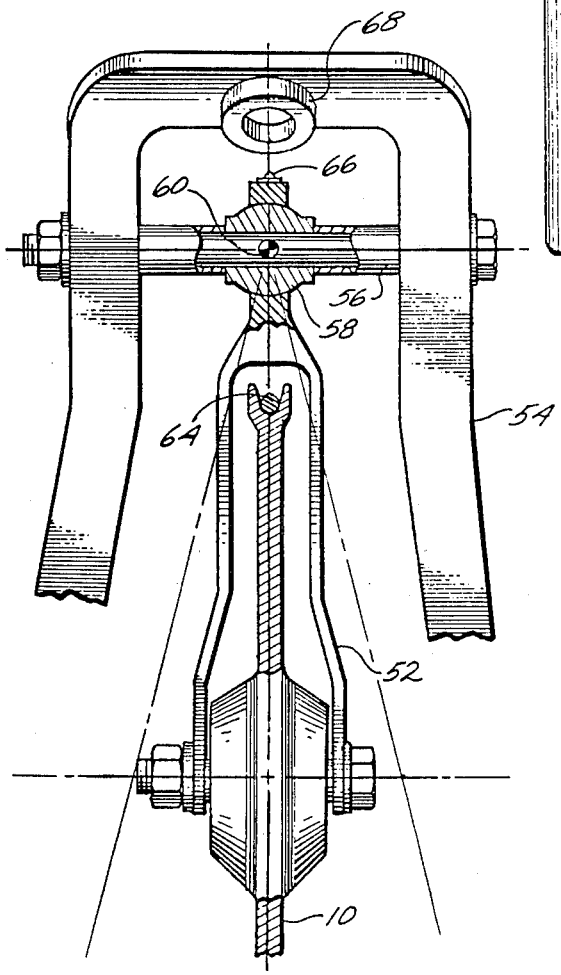
FIG. 4 is a partial sectional view taken along line 4—4 of the device of FIG. 3.

Another embodiment of my invention is shown in FIGS. 3 and 4. In FIG. 3, a sheave 50 is shown carried in a fork member 52 supported in a frame 54 by means of a cross-shaft 56 and a monoball structure 58 (see FIG. 4). The monoball member 58 is attached to shaft 56. The fork member 52 is movable relative to the monoball 58 in the plane of the sheave 50, as shown by the lines indicating the travel of fork 52 on FIG. 3. From observation of the monoball on FIGS. 3 and 4, it is apparent that fork 52 can also rotate around an axis indicated by numeral 60 which is essentially the same axis shown at numeral 21 in FIG. 2. The monoball is also so constructed as to permit movement around an axis 62 passing vertically through the monoball, and it is movement around this axis which enables the sheave to follow the movement of the cable 64 as it is directed by the level wind mechanism.

Attached to the top of the fork member 52 above the monoball 58 is a small lamp 66. This lamp directs a beam of light toward a two-axis photocell 68 fastened to the lower side of frame member 54. As a means of keeping both the lamp 66 and the photocell 68 clean, both are housed within a flexible bellows member 70 which may be formed of any suitable flexible material such as synthetic rubber. This bellows 70 is shown broken away, but it will be understood that its top end is sealed to the bottom side of frame member 54 around the photocell 68. A photocell which has been found operative for this purpose is one called Pin Spot/8D, manufactured by United Detector Technology, Inc., 1732 21st Street, Santa Monica, California 90404. It will be recognized that the monoball structure shown in FIGS. 3 and 4 provides essentially the same kind of swiveling operation as that provided by the structure of FIGS. 1 and 2. As the sheave 50 is moved in its own plane as shown in FIG. 3, the lamp 66 will have a directly corresponding movement and its spot of light will contact photocell 68 in a new location spaced from null. This photocell, having for quadrants and being electrically connected such that its output varies in a desired proportion with the distance of the light spot from the center of the cell, thereby produces a signal indicating the direction of movement and the magnitude of the movement away from the null position. A completely analogous kind of output results from the movement of the sheave around axis 60, where again the photocell will respond to movement of the beam of light directed by lamp 66 to produce an output representing both the direction and magnitude of movement away from the null position. Rotation around vertical axis 62, however, unless accompanied by movement at the same time in another axis as well, results in no change in the position of the light beam and no output from the photocell.

While only two embodiments have been shown and described herein, those skilled in the art will recognize that modifications may be made within the scope of the present invention. Thus the rotary linear transformers, which actually have an alternating current output, could also be replaced with other types of a.c. or d.c. electrical signal-producing devices of which the simplest might be a potentiometer. In some installations an electrical response in only one plane of movement may be needed. The magnitude of movement dealt with herein was limited to a cone of cable angle departing from the vertical by about 15°, but larger or smaller angles may be involved in any particular installation.

I claim:

1. In combination a cable-directing sheave and support therefor comprising:

a frame and a first support member in said frame including means permitting said sheave to rotate in its own plane, a second support means carried on said first support member including means permitting said sheave to rotate in a second plane perpendicular to said first named plane and a third plane perpendicular to both said first named and second planes, said second support means comprising a fork member carrying said sheave, a monoball on said first support member and a mating surface on said second support means for receiving said monoball, said sheave being positioned in said fork member such that the axes of rotation of said means permitting rotation in said second or third planes are in substantial alignment with a cable on said sleeve, and photoelectric means installed on said frame and on said mating surface of said second support means for generating electrical signals representative of the departure of said sheave from a null position.

2. A cable-directing sheave and support structure therefor as set forth in claim 1 wherein said photoelectric means includes a two-axis photocell capable of indicating movement away from a null position in either of two planes.

3. A cable-directing sheave and support structure therefor as set forth in claim 2 wherein said photocell is carried on said frame and a lamp directed toward said photocell is positioned on said fork.

* * * * *